US005654606A

United States Patent [19]

Weijtens et al.

[11] Patent Number: 5,654,606

[45] Date of Patent: Aug. 5, 1997

[54] LOW-PRESSURE DISCHARGE LAMP HAVING METAL AND CERAMIC ELECTRODES

[75] Inventors: Christianus H. L. Weijtens, Waalre, Netherlands; Detlev Hennings, Aachen, Germany

[73] Assignee: U.S. Philips Corporation, New York, N.Y.

[21] Appl. No.: 554,124

[22] Filed: Nov. 6, 1995

[30] Foreign Application Priority Data

Nov. 8, 1994 [EP] European Pat. Off. ..... 94203248

[51] Int. Cl.[6] ..... H01J 61/067

[52] U.S. Cl. ..... 313/491; 313/574; 313/623; 313/631; 313/633; 313/346 R; 313/630

[58] Field of Search ..... 313/491, 572, 313/574, 623, 624, 625, 626, 630, 631, 633, 311, 332, 346 R, 352

[56] References Cited

U.S. PATENT DOCUMENTS

| | | | |
|---|---|---|---|
| 2,847,605 | 8/1958 | Byer | 313/491 X |
| 2,888,592 | 5/1959 | Laffrty | 313/491 X |
| 3,101,426 | 8/1963 | Takayama et al. | 313/491 X |
| 3,505,553 | 4/1970 | Piree | 313/491 X |
| 3,563,797 | 2/1971 | Young et al. | 313/491 X |
| 3,798,492 | 3/1974 | Menelly | 313/346 R X |
| 4,574,219 | 3/1986 | Davenport et al. | 313/633 X |
| 5,138,224 | 8/1992 | Goldburt et al. | 313/491 |

FOREIGN PATENT DOCUMENTS 529392 7/1931 Germany .

*Primary Examiner*—Ashok Patel
*Attorney, Agent, or Firm*—Walter M. Egbert, III

[57] ABSTRACT

A low-pressure discharge lamp according to the invention is provided with a radiation-transmitting discharge vessel which encloses a discharge space containing an ionizable filling in a gastight manner, and electrodes arranged in the discharge space between which a discharge path extends. At least one of the electrodes is a sintered mixture of metal and ceramic material, the proportional quantity of metal in the mixture being small compared with the proportional quantity of ceramic material. The sintered mixture includes smaller ceramic particles with a modal diameter D1 and larger ceramic particles with a modal diameter D2, the ratio D2/D1 being at least 3, while the proportional volume of the smaller ceramic particles is small compared with that of the larger ceramic particles. In the lamp according to the invention, the electrodes have a comparatively high resistance to temperature variations in spite of the small proportional volume of metal particles.

18 Claims, 1 Drawing Sheet

LOW-PRESSURE DISCHARGE LAMP HAVING METAL AND CERAMIC ELECTRODES

BACKGROUND OF THE INVENTION

The invention relates to a low-pressure discharge lamp provided with a radiation-transmitting discharge vessel which encloses a discharge space containing an ionizable filling in a gastight manner, and comprising electrodes arranged in the discharge space between which a discharge path extends, while at least one of the electrodes comprises a sintered mixture of metal and ceramic material, the proportional quantity of metal in the mixture being small in relation to the proportional quantity of ceramic material.

Such a lamp is known from German Patent 529 392. The known lamp has electrodes sintered from a mixture of a metal, such as W or Mo, and a ceramic material, such as an oxide or a silicate of an alkali metal, an alkaline earth, or a rare earth, the proportional quantity of metal being small compared with the quantity of ceramic material. The use of such electrodes has the advantage that a high current density is possible, so that the electrode can be comparatively thin, if so desired. This is of particular importance for lamps having comparatively narrow discharge vessels.

Ceramic materials are comparatively prone to fracture in the case of abrupt temperature changes. Such temperature changes may occur in the electrodes upon switching-on of discharge lamps. The presence of metal, which is comparatively ductile, can considerably increase the resistance to such temperature changes, provided it is present in the ceramic material in a sufficiently continuous structure. The continuity of the metal, however, decreases with a decreasing proportional volume of the metal.

SUMMARY OF THE INVENTION

The invention has for its object to provide a lamp of the kind mentioned in the opening paragraph whose electrodes have a construction which has a comparatively high resistance to temperature variations with a comparatively low proportional quantity of metal.

According to the invention, the lamp is for this purpose characterized in that the sintered mixture comprises besides smaller ceramic particles with a modal diameter D1 aim larger ceramic particles with a modal diameter D2, the ratio D2/D1 being at least 3, while the proportional volume of the smaller ceramic particles is small compared with that of the larger ceramic particles. The term "modal diameter" is understood to mean a diameter for which the particle size distribution has a maximum. In the lamp according to the invention, the smaller and the larger ceramic particles together provide a comparatively dense packing because the smaller ceramic particles fill up spaces between the larger ceramic particles. It is possible with comparatively little metal nevertheless to form a highly continuous network in the remaining space between the smaller and larger ceramic particles. The modal diameters D1 and D2 are determined by means of the linear intercept method. In this method, the length distribution of line segments, each segment being defined by the circumference of a particle and lying on a common (arbitrary) line in a cross-section through the sintered mixture, is determined in a microscopic image of said cross-section. The modal diameters D1 and D2 are subsequently calculated from the length distribution thus obtained.

The ceramic particles are preferably made of a material having a low work function. Suitable are, for example, barium and strontium compounds such as BaO and SrO. Favourable compounds are mixed oxides of Ba and/or Sr with one or more of the metals from the series comprising Ta, Ti, Zr, such as $Ba_4Ta_2O_9$, $BaTiO_3$, $Ba_2TiO_4$, $BaZrO_3$, $SrTiO_3$, $SrZrO_3$, $Ba_{0.5}Sr_{0.5}TiO_3$, $Ba_{0.5}Sr_{0.5}ZrO_3$, and /or with one several rare earths (Sc, Y, La, and the lanthanides), such as $BaCeO_3$. Such compounds do not or hardly react with components from the atmosphere, which simplifies lamp manufacture. The metal used in the sintered electrode preferably has a comparatively low vapour pressure at the operating temperatures obtaining in the electrode. Very suitable are, for example, W, Mo, Re, and Ta. Also suitable are the comparatively expensive metals Os, Ru, and Ir. Metals such as Ni and Fe may also be used in lamps whose ionizable fillings comprise exclusively rare gases.

An embodiment of the lamp according to the invention which is comparatively easy to manufacture is characterized in that the modal diameter D1 of the smaller ceramic particles and the modal diameter D2 of the larger ceramic particles lie between 5 and 10 μm and between 20 and 70 μm, respectively. This embodiment has the additional advantage that the reproducibility of the electrical and thermal conductance is great also in the case of comparatively thin electrodes, for example of the order of 0.5 min. Since the modal diameter of the larger ceramic particles is comparatively small in relation to the electrode diameter, the fraction of the transverse surface area occupied by the larger particles, and thus the electrical and thermal conductance, shows little dispersion.

Preferably, the manufacture of the electrodes starts with metal particles which have approximately the same size as or are smaller than the smaller ceramic particles. The starting material is, for example, a powder of metal particles having a modal diameter of 0.5 to 1.5 μm. The metal particles may have been fused together in the sintered electrodes.

An attractive embodiment of the low-pressure discharge lamp according to the invention is characterized in that the proportional volume of the smaller ceramic particles divided by the proportional volume of metal lies between 1 and 4, and in that the proportional volume of the larger ceramic particles divided by the joint proportional volume of the smaller ceramic particles and the metal lies between 2 and 10. This embodiment has the advantage that the electrode is sufficiently electrically conductive also with the use of insulating ceramic materials, while nevertheless the heat conduction is comparatively low. A comparatively low heat conduction is favourable for realising a temperature of the electrode tips which is sufficiently high for thermal emission with comparatively low thermal losses.

A further attractive embodiment of the low-pressure discharge lamp according to the invention is characterized in that the smaller ceramic particles are made of a semiconducting ceramic material such as doped barium titanate or strontium titanate (for example, doped with a rare earth). This renders possible a reduction of the proportional quantity of metal in the mixture, and thus a further increase in the heat resistance of the electrodes, while the electrical resistance thereof can remain at least substantially unchanged.

Preferably, the smaller and the larger ceramic particles of the mixture have approximately the same coefficient of expansion. This enhances the temperature resistance of the electrodes. A favourable embodiment of the low-pressure discharge lamp according to the invention is therefore characterized in that the smaller and the larger ceramic particles are substantially made of the same material.

An advantageous embodiment of the low-pressure discharge lamp according to the invention is characterized in that an end portion of the electrode is fastened in an end of a metal tube. Preferably, the electrode is fastened in the tube with a soldered joint. A reliable electrical and mechanical connection between the electrode and the metal tube is obtained thereby. Alternatively, the end portion of the electrode may, for example, be, clamped in an end of a metal tube. The assembly of the electrode and the metal tube may be readily mounted in the discharge vessel.

The metal tube is, for example, welded or soldered at the opposed end to a metal pin which issues from the discharge vessel to the exterior and serves as a current supply conductor. The discharge vessel may be evacuated and filled through an exhaust tube integral with the discharge vessel and subsequently closed by fusion.

Preferably, however, the tube extends to outside the discharge vessel. The tube may then act as the current supply conductor. It is favourable when the tube is provided with an opening in the discharge space, so that it can then act as an exhaust tube during manufacture. The opening in the tube is realised, for example, in that there is a clearance over a portion of the circumference between the electrode and the metal tube. The tube may be closed off with glass at the end remote from the electrode. Alternatively, the tube may be, for example, closed by welding at that end.

In another embodiment, for example, the electrode is sintered to a metal pin which is passed through the wall of the discharge vessel.

BRIEF DESCRIPTION OF THE DRAWINGS

These and other aspects of the low-pressure discharge lamp according to the invention will be explained in more detail with reference to a drawing, in which FIG. 1 diagrammatically shows a first embodiment.

DESCRIPTION OF THE PREFERRED EMBODIMENTS

Figure 1:
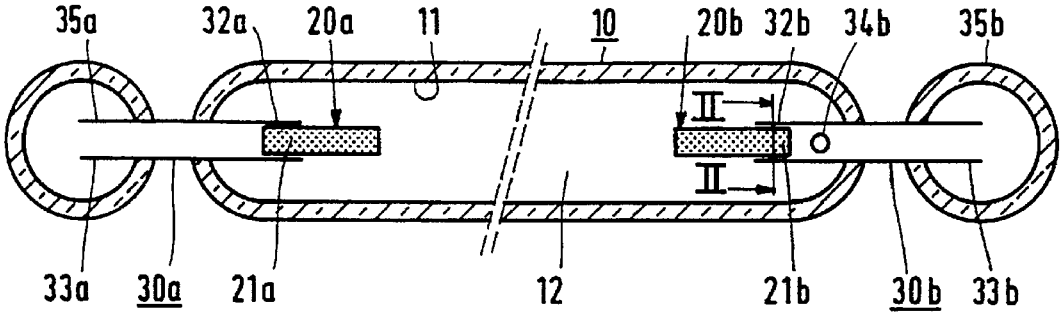

The low-pressure discharge lamp shown in FIG. 1 is provided with a tubular discharge vessel 10 of 5 mm internal diameter which is provided with a luminescent layer 11 on an inner surface and which encloses a discharge space 12 in a gastight manner, said space containing an ionizable filling, here of mercury and argon. The discharge vessel 10 is made of lime glass which transmits the visible radiation generated in the luminescent layer 11. Electrodes 20*a*, 20*b* of 0.5 mm diameter and 10 mm length are arranged in the discharge space 11. An end portion 21*a*, 21*b* of each electrode 20*a*, 20*b* is soldered by means of nickel 31*b* (shown dotted in FIG. 2) in an end 32*a*, 32*b* of a metal tube 30*a*, 30*b* extending to outside the discharge vessel 10. The tubes 30*a*, 30*b* serve as current supply conductors. One of the tubes 30*a*, 30*b* is provided with an opening 34*b* in the discharge space 12. The end 33*a*, 33*b* of each tube 30*a*, 30*b* remote from the electrodes 20*a*, 20*b* is closed off with glass 35*a*, 35*b*. The electrodes 20*a*, 20*b* are sintered from a mixture of ceramic materials 22, 24 and metal 23, the metal 23 being shown in black in between the ceramic particles 22, 24, the proportional quantity of metal being comparatively small. In the embodiment shown, the proportional volume of the metal is 3%. The sintered mixture comprises smaller ceramic particles 22 with a modal diameter D1 of 7 μm and larger ceramic particles 24 with a modal diameter D2 of 50 μm. The ratio D2/D1 is 7.1, i.e. is at least 3. The diameters D1 and D2 were determined by the linear intercept method. The particles 22, 24 are shown larger in the drawing for the sake of clarity than would be the case if the drawing were true to scale. The proportional volume of the smaller ceramic particles 22 is 9%, i.e. small compared with the proportional volume of the larger ceramic particles 24, which is 88%.

The proportional volume of the smaller ceramic particles (9% ) divided by the proportional volume of metal (3%) is 3 and lies between said limits of 1 and 4. The proportional volume of the larger ceramic particles (88%) divided by the joint proportional volume (9%+3%) of the smaller ceramic particles and the metal is 7.3, and lies between the limits 2 and 10.

The smaller and the larger ceramic particles 22, 24 of the mixture are both of semiconducting Y-doped $BaTiO_3$. W is used as Re metal 23.

The electrodes 20*a*, 20*b* were obtained as follows. W-powder (modal particle diameter 1 μm) and $BaTiO_3$ powders (modal particle diameters 1 μm and 50 μm, respectively) were mixed in the desired proportions. (The modal particle diameters of the powders were determined by sedimentation). Then the mixture was isostatically compressed and subsequently heated for some time in a reducing $N_2/H_2$ atmosphere. Particles of the $BaTiO_3$ powder of 1 μm modal particle diameter grew together during this step, whereby particles with a modal diameter of 7 μm were formed. The electrodes were manufactured from the material thus obtained through sawing. Alternatively, said powders may be mixed with a binder and subsequently extruded, fired for removing the binder and, for example, heated in a reducing $N_2/H_2$ atmosphere. The rod thus obtained may be sawn into pieces of the length desired for the electrode application. A high porosity of the larger ceramic particles contributes to a low heat conductance, which is favourable for electrode operation.

The larger ceramic particles may be obtained, for example, by presintering from a powder of finer particles.

Figure 2:
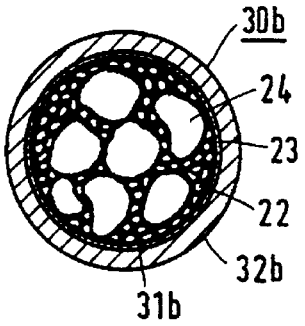
FIG. 2 shows a cross-section taken on the line II—II in FIG. 1 in more detail. A second and a third embodiment are shown in FIGS. 3 and 4, respectively.
Figure 3:
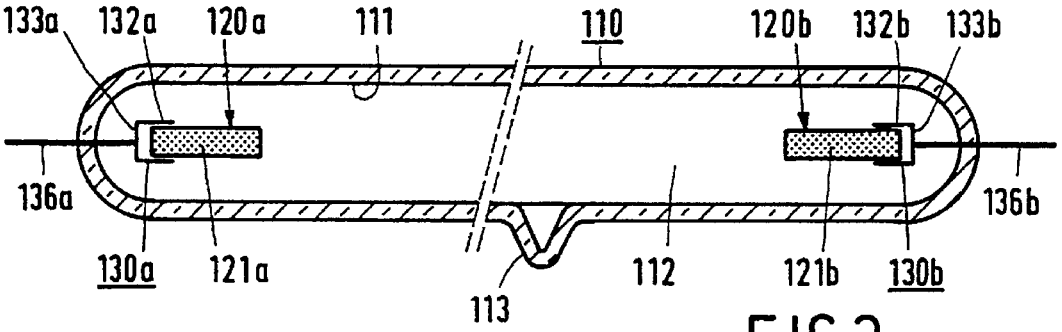

In FIG. 3, components corresponding to those of FIG. 1 or FIG. 2 have reference numerals which are 100 higher. In the embodiment of the lamp according to the invention shown in FIG. 3, an end portion 121*a*, 121*b* of each electrode 120*a*, 120*b* is clamped in an end 132*a*, 132*b* of a metal tube 130*a*, 130*b*. A metal pin 136*a*, 136*b* is fastened by welding to the opposed, closed end 133*a*, 133*b* of each tube 130*a*, 130*b*. The pin 136*a*, 136*b* issues through the wall of the discharge vessel 110 to the exterior and serves as a current supply conductor. The discharge vessel 110 was evacuated and filled through an integral exhaust tube 113. The exhaust tube 113 was subsequently tipped.

Figure 4:
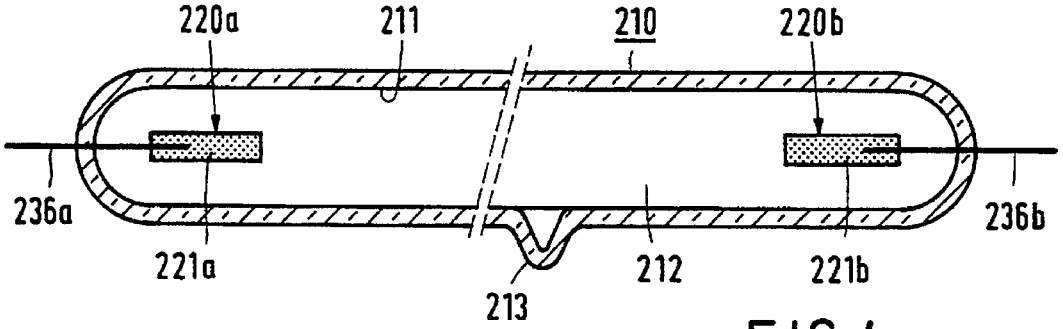

In FIG. 4, components corresponding to those of FIG. 1 or FIG. 2 have reference numerals which are 200 higher. Components corresponding to those of FIG. 3 have reference numerals which are 100 higher. FIG. 4 shows an embodiment of the lamp according to the invention in which the electrodes 220*a*, 220*b* are each fixed by sintering to a metal pin 236*a*, 236*b* which issues through the wall of the discharge vessel 210 to the exterior.

We claim:

1. A low-pressure discharge lamp provided with a radiation-transmitting discharge vessel which encloses a discharge space containing an ionizable filling in a gastight manner, and comprising electrodes arranged in the discharge space between which a discharge path extends, while at least one of the electrodes comprises a sintered mixture of metal and ceramic material, a proportional quantity of metal in a mixture being small in relation to the proportional quantity of ceramic material, characterized in that the sintered mixture comprises besides smaller ceramic particles with a modal diameter D1 also larger ceramic particles with a modal diameter D2, the ratio D2/D1 being at least 3, while a proportional volume of the smaller ceramic particles is small compared with that of the larger ceramic particles.

2. A low-pressure discharge lamp as claimed in claim 1, characterized in that an end portion of each electrode is fastened in an end of a metal tube.

3. A low-pressure discharge lamp as claimed in claim 1, characterized in that the larger ceramic particles are substantially made of the same material as the smaller ceramic particles.

4. A low-pressure discharge lamp as claimed in claim 1, characterized in that the smaller ceramic particles are made of a semiconducting ceramic material.

5. A low-pressure discharge lamp as claimed in claim 1, characterized in that the proportional volume of the smaller ceramic particles divided by a proportional volume of metal lies between 1 and 4, and in that the proportional volume of the larger ceramic particles divided by the joint proportional volume of the smaller ceramic particles and the metal lies between 2 and 10.

6. A low-pressure discharge lamp as claimed in claim 1, characterized in that the modal diameter D1 of the smaller ceramic particles and the modal diameter D2 of the larger ceramic particles lie between 5 and 10 μm and between 20 and 70 μm, respectively.

7. A low-pressure discharge lamp as claimed in claim 6, characterized in that an end portion of each electrode is fastened in an end of a metal tube.

8. A low-pressure discharge lamp as claimed in claim 6, characterized in that the larger ceramic particles are substantially made of the same material as the smaller ceramic particles.

9. A low-pressure discharge lamp as claimed in claim 6, characterized in that the smaller ceramic particles are made of a semiconducting ceramic material.

10. A low-pressure discharge lamp as claimed in claim 6, characterized in that the proportional volume of the smaller ceramic particles divided by a proportional volume of metal lies between 1 and 4, and in that the proportional volume of the larger ceramic particles divided by the combined proportional volume of the smaller ceramic particles and the metal lies between 2 and 10.

11. A low-pressure discharge lamp as claimed in claim 10, characterized in that an end portion of each electrode is fastened in an end of a metal tube.

12. A low-pressure discharge lamp as claimed in claim 10, characterized in that the larger ceramic particles are substantially made of the same material as the smaller ceramic particles.

13. A low-pressure discharge lamp as claimed in claim 10, characterized in that the smaller ceramic particles are made of a semiconducting ceramic material.

14. A low-pressure discharge lamp as claimed in claim 13, characterized in that an end portion of each electrode is fastened in an end of a metal tube.

15. A low-pressure discharge lamp as claimed in claim 13, characterized in that the larger ceramic particles are substantially made of the same material as the smaller ceramic particles.

16. A low-pressure discharge lamp as claimed in claim 15, characterized in that an end portion of each electrode is fastened in an end of a metal tube.

17. A low-pressure discharge lamp as claimed in claim 16, characterized in that the metal tube extends to outside the discharge vessel.

18. A low-pressure discharge lamp as claimed in claim 17, characterized in that the metal tube is provided with an opening in the discharge space.

* * * * *